US008056651B2

(12) United States Patent
Turner et al.

(10) Patent No.: US 8,056,651 B2
(45) Date of Patent: Nov. 15, 2011

(54) ADAPTIVE CONTROL CONCEPT FOR HYBRID PDC/ROLLER CONE BITS

(75) Inventors: Evan Turner, Cedar City, UT (US); Eric Sullivan, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 316 days.

(21) Appl. No.: 12/431,570

(22) Filed: Apr. 28, 2009

(65) Prior Publication Data

US 2010/0270085 A1 Oct. 28, 2010

(51) Int. Cl.
*E21B 10/62* (2006.01)
*E21B 10/14* (2006.01)

(52) U.S. Cl. ..... 175/381

(58) Field of Classification Search ..... 175/96, 175/281, 288, 381, 319
See application file for complete search history.

(56) References Cited

U.S. PATENT DOCUMENTS

| | | | | | |
|---|---|---|---|---|---|
| 930,759 | A | | 8/1909 | Hughes | |
| 1,519,641 | A | * | 12/1924 | Thompson | 175/281 |
| 1,821,474 | A | * | 9/1931 | Mercer | 175/289 |
| 1,874,066 | A | | 8/1932 | Scott et al. | |
| 1,879,127 | A | | 9/1932 | Schlumpf | |
| 1,932,487 | A | | 10/1933 | Scott | |
| 2,030,722 | A | | 2/1936 | Scott | |
| 2,198,849 | A | | 4/1940 | Waxler | |
| 2,216,894 | A | | 10/1940 | Stancliff | |
| 2,244,537 | A | | 6/1941 | Kammerer | |
| 2,297,157 | A | | 9/1942 | McClinton | |
| 2,320,136 | A | | 5/1943 | Kammerer | |
| 2,320,137 | A | | 5/1943 | Kammerer | |
| 2,380,112 | A | | 7/1945 | Kinnear | |
| RE23,416 | E | | 10/1951 | Kinnear | |
| 2,719,026 | A | | 9/1955 | Boice | |
| 2,815,932 | A | * | 12/1957 | Wolfram | 175/288 |
| 2,994,389 | A | * | 8/1961 | Le Bus, Sr. | 175/321 |
| 3,010,708 | A | | 11/1961 | Hlinsky et al. | |

(Continued)

FOREIGN PATENT DOCUMENTS

DE 13 01 784 8/1969

(Continued)

OTHER PUBLICATIONS

Beijer, G., International Preliminary Report on Patentability for International Patent Application No. PCT/US2009/042514, The International Bureau of WIPO, dated Nov. 2, 2010.

(Continued)

*Primary Examiner* — Jennifer H Gay
*Assistant Examiner* — Blake Michener
(74) *Attorney, Agent, or Firm* — Locke Lord LLP

(57) ABSTRACT

An earth boring drill bit comprising a bit body having a longitudinal axis along a path of the bit, a first plurality of cutters mounted to the body, and a second plurality of cutters rotatably mounted to the body, wherein a longitudinal axial relationship between the first plurality of cutters and the second plurality of cutters is adjustable. The first and/or second plurality of cutters may be mounted to the body in such a manner as to allow them to slide parallel to the longitudinal axis. The longitudinal axial relationship may be adjusted to exchange the first plurality of cutters and the secondary plurality of cutters between a primary cutting position and a secondary cutting position. The bit may include a sensor to provide an indication of a formation type being excavated by the bit and a processor to control the longitudinal axial relationship based on the indication.

18 Claims, 5 Drawing Sheets

U.S. PATENT DOCUMENTS

| | | | | |
|---|---|---|---|---|
| 3,055,443 | A | 9/1962 | Edwards | |
| 3,066,749 | A | 12/1962 | Hildebrandt | |
| 3,126,066 | A | 3/1964 | Williams, Jr. | |
| 3,174,564 | A | 3/1965 | Morlan | |
| 3,239,431 | A | 3/1966 | Raymond | |
| 3,269,469 | A | 8/1966 | Kelly, Jr. | |
| 3,387,673 | A * | 6/1968 | Thompson | 175/96 |
| 3,424,258 | A | 1/1969 | Nakayama | |
| 3,583,501 | A * | 6/1971 | Aalund | 175/96 |
| RE28,625 | E | 11/1975 | Cunningham | |
| 4,006,788 | A | 2/1977 | Garner | |
| 4,140,189 | A | 2/1979 | Garner | |
| 4,190,126 | A | 2/1980 | Kabashima | |
| 4,270,812 | A | 6/1981 | Thomas | |
| 4,285,409 | A | 8/1981 | Allen | |
| 4,293,048 | A | 10/1981 | Kloesel, Jr. | |
| 4,320,808 | A | 3/1982 | Garrett | |
| 4,343,371 | A | 8/1982 | Baker, III et al. | |
| 4,359,112 | A | 11/1982 | Garner et al. | |
| 4,369,849 | A | 1/1983 | Parrish | |
| 4,386,669 | A * | 6/1983 | Evans | 175/269 |
| 4,410,284 | A | 10/1983 | Herrick | |
| 4,444,281 | A | 4/1984 | Schumacher, Jr. et al. | |
| 4,527,637 | A | 7/1985 | Bodine | |
| 4,572,306 | A | 2/1986 | Dorosz | |
| 4,657,091 | A | 4/1987 | Higdon | |
| 4,664,705 | A | 5/1987 | Horton et al. | |
| 4,690,228 | A | 9/1987 | Voelz et al. | |
| 4,726,718 | A | 2/1988 | Meskin et al. | |
| 4,727,942 | A | 3/1988 | Galle et al. | |
| 4,738,322 | A | 4/1988 | Hall et al. | |
| 4,765,205 | A | 8/1988 | Higdon | |
| 4,874,047 | A | 10/1989 | Hixon | |
| 4,875,532 | A | 10/1989 | Langford, Jr. | |
| 4,892,159 | A | 1/1990 | Holster | |
| 4,915,181 | A | 4/1990 | Labrosse | |
| 4,932,484 | A | 6/1990 | Warren et al. | |
| 4,936,398 | A | 6/1990 | Auty et al. | |
| 4,943,488 | A | 7/1990 | Sung et al. | |
| 4,953,641 | A | 9/1990 | Pessier | |
| 4,984,643 | A | 1/1991 | Isbell et al. | |
| 4,991,671 | A | 2/1991 | Pearce et al. | |
| 5,016,718 | A | 5/1991 | Tandberg | |
| 5,027,912 | A | 7/1991 | Juergens | |
| 5,028,177 | A | 7/1991 | Meskin et al. | |
| 5,030,276 | A | 7/1991 | Sung et al. | |
| 5,049,164 | A | 9/1991 | Horton et al. | |
| 5,116,568 | A | 5/1992 | Sung et al. | |
| 5,145,017 | A | 9/1992 | Holster et al. | |
| 5,176,212 | A | 1/1993 | Tandberg | |
| 5,224,560 | A | 7/1993 | Fernandez | |
| 5,238,074 | A | 8/1993 | Tibbitts et al. | |
| 5,287,936 | A | 2/1994 | Grimes et al. | |
| 5,289,889 | A | 3/1994 | Gearhart et al. | |
| 5,337,843 | A | 8/1994 | Torgrimsen et al. | |
| 5,346,026 | A | 9/1994 | Pessier et al. | |
| 5,361,859 | A * | 11/1994 | Tibbitts | 175/286 |
| 5,429,200 | A | 7/1995 | Blackman et al. | |
| 5,439,068 | A | 8/1995 | Huffstutler et al. | |
| 5,452,771 | A | 9/1995 | Blackman et al. | |
| 5,467,836 | A | 11/1995 | Grimes et al. | |
| 5,472,057 | A * | 12/1995 | Winfree | 175/57 |
| 5,472,271 | A | 12/1995 | Bowers et al. | |
| 5,513,715 | A | 5/1996 | Dysart | |
| 5,518,077 | A | 5/1996 | Blackman et al. | |
| 5,547,033 | A | 8/1996 | Campos, Jr. | |
| 5,553,681 | A | 9/1996 | Huffstutler et al. | |
| 5,558,170 | A | 9/1996 | Thigpen et al. | |
| 5,560,440 | A * | 10/1996 | Tibbitts | 175/384 |
| 5,570,750 | A | 11/1996 | Williams | |
| 5,593,231 | A | 1/1997 | Ippolito | |
| 5,606,895 | A | 3/1997 | Huffstutler | |
| 5,624,002 | A | 4/1997 | Huffstutler | |
| 5,641,029 | A | 6/1997 | Beaton et al. | |
| 5,644,956 | A | 7/1997 | Blackman et al. | |
| 5,655,612 | A | 8/1997 | Grimes et al. | |
| D384,084 | S | 9/1997 | Huffstutler et al. | |
| 5,695,018 | A | 12/1997 | Pessier et al. | |
| 5,695,019 | A | 12/1997 | Shamburger, Jr. | |
| 5,755,297 | A | 5/1998 | Young et al. | |
| 5,862,871 | A | 1/1999 | Curlett | |
| 5,868,502 | A | 2/1999 | Cariveau et al. | |
| 5,873,422 | A | 2/1999 | Hansen et al. | |
| 5,941,322 | A | 8/1999 | Stephenson et al. | |
| 5,944,125 | A | 8/1999 | Byrd | |
| 5,967,246 | A | 10/1999 | Caraway et al. | |
| 5,979,576 | A | 11/1999 | Hansen et al. | |
| 5,988,303 | A | 11/1999 | Arfele | |
| 5,992,542 | A | 11/1999 | Rives | |
| 5,996,713 | A | 12/1999 | Pessier et al. | |
| 6,092,613 | A | 7/2000 | Caraway et al. | |
| 6,095,265 | A | 8/2000 | Alsup | |
| 6,109,375 | A | 8/2000 | Tso | |
| 6,116,357 | A | 9/2000 | Wagoner et al. | |
| 6,173,797 | B1 | 1/2001 | Dykstra et al. | |
| 6,220,374 | B1 | 4/2001 | Crawford | |
| 6,241,036 | B1 | 6/2001 | Lovato et al. | |
| 6,260,635 | B1 | 7/2001 | Crawford | |
| 6,279,671 | B1 | 8/2001 | Panigrahi et al. | |
| 6,283,233 | B1 | 9/2001 | Lamine et al. | |
| 6,296,069 | B1 | 10/2001 | Lamine et al. | |
| RE37,450 | E | 11/2001 | Deken et al. | |
| 6,345,673 | B1 | 2/2002 | Siracki | |
| 6,360,831 | B1 | 3/2002 | Akesson et al. | |
| 6,386,302 | B1 | 5/2002 | Beaton | |
| 6,401,844 | B1 | 6/2002 | Doster et al. | |
| 6,405,811 | B1 | 6/2002 | Borchardt | |
| 6,408,958 | B1 | 6/2002 | Isbell et al. | |
| 6,415,687 | B2 | 7/2002 | Saxman | |
| 6,439,326 | B1 | 8/2002 | Huang et al. | |
| 6,446,739 | B1 | 9/2002 | Richman et al. | |
| 6,450,270 | B1 | 9/2002 | Saxton | |
| 6,474,424 | B1 | 11/2002 | Saxman | |
| 6,510,906 | B1 | 1/2003 | Richert et al. | |
| 6,510,909 | B2 | 1/2003 | Portwood et al. | |
| 6,527,066 | B1 | 3/2003 | Rives | |
| 6,533,051 | B1 | 3/2003 | Singh et al. | |
| 6,544,308 | B2 | 4/2003 | Griffin et al. | |
| 6,562,462 | B2 | 5/2003 | Griffin et al. | |
| 6,568,490 | B1 | 5/2003 | Tso et al. | |
| 6,585,064 | B2 | 7/2003 | Griffin et al. | |
| 6,589,640 | B2 | 7/2003 | Griffin et al. | |
| 6,592,985 | B2 | 7/2003 | Griffin et al. | |
| 6,601,661 | B2 | 8/2003 | Baker et al. | |
| 6,601,662 | B2 | 8/2003 | Matthias et al. | |
| 6,684,967 | B2 | 2/2004 | Mensa-Wilmot et al. | |
| 6,729,418 | B2 | 5/2004 | Slaughter, Jr. et al. | |
| 6,739,214 | B2 | 5/2004 | Griffin et al. | |
| 6,742,607 | B2 | 6/2004 | Beaton | |
| 6,745,858 | B1 * | 6/2004 | Estes | 175/384 |
| 6,749,033 | B2 | 6/2004 | Griffin et al. | |
| 6,797,326 | B2 | 9/2004 | Griffin et al. | |
| 6,843,333 | B2 | 1/2005 | Richert et al. | |
| 6,861,098 | B2 | 3/2005 | Griffin et al. | |
| 6,861,137 | B2 | 3/2005 | Griffin et al. | |
| 6,878,447 | B2 | 4/2005 | Griffin et al. | |
| 6,883,623 | B2 | 4/2005 | McCormick et al. | |
| 6,902,014 | B1 | 6/2005 | Estes | |
| 6,986,395 | B2 | 1/2006 | Chen | |
| 6,988,569 | B2 | 1/2006 | Lockstedt et al. | |
| 7,096,978 | B2 | 8/2006 | Dykstra et al. | |
| 7,111,694 | B2 | 9/2006 | Beaton | |
| 7,137,460 | B2 | 11/2006 | Slaughter, Jr. et al. | |
| 7,152,702 | B1 | 12/2006 | Bhome et al. | |
| 7,198,119 | B1 * | 4/2007 | Hall et al. | 175/57 |
| 7,234,550 | B2 | 6/2007 | Azar et al. | |
| 7,270,196 | B2 * | 9/2007 | Hall | 175/57 |
| 7,281,592 | B2 | 10/2007 | Runia et al. | |
| 7,350,568 | B2 | 4/2008 | Mandal et al. | |
| 7,350,601 | B2 | 4/2008 | Belnap et al. | |
| 7,360,612 | B2 | 4/2008 | Chen et al. | |
| 7,377,341 | B2 | 5/2008 | Middlemiss et al. | |
| 7,387,177 | B2 | 6/2008 | Zahradnik et al. | |
| 7,392,862 | B2 | 7/2008 | Zahradnik et al. | |
| 7,398,837 | B2 * | 7/2008 | Hall et al. | 175/50 |
| 7,416,036 | B2 | 8/2008 | Forstner et al. | |
| 7,435,478 | B2 | 10/2008 | Keshavan | |

| | | | | |
|---|---|---|---|---|
| 7,462,003 | B2 | 12/2008 | Middlemiss | |
| 7,473,287 | B2 | 1/2009 | Belnap et al. | |
| 7,493,973 | B2 | 2/2009 | Keshavan et al. | |
| 7,517,589 | B2 | 4/2009 | Eyre | |
| 7,533,740 | B2 | 5/2009 | Zhang et al. | |
| 7,568,534 | B2 | 8/2009 | Griffin et al. | |
| 7,836,975 | B2 * | 11/2010 | Chen et al. | 175/266 |
| 7,845,435 | B2 * | 12/2010 | Zahradnik et al. | 175/336 |
| 2002/0092684 | A1 | 7/2002 | Singh et al. | |
| 2002/0108785 | A1 | 8/2002 | Slaughter, Jr. et al. | |
| 2004/0238224 | A1 | 12/2004 | Runia | |
| 2005/0087370 | A1 | 4/2005 | Ledgerwood, III et al. | |
| 2005/0103533 | A1 | 5/2005 | Sherwood, Jr. et al. | |
| 2005/0178587 | A1 | 8/2005 | Witman, IV et al. | |
| 2005/0183892 | A1 | 8/2005 | Oldham et al. | |
| 2005/0263328 | A1 | 12/2005 | Middlemiss | |
| 2005/0273301 | A1 * | 12/2005 | Huang | 703/10 |
| 2006/0032674 | A1 | 2/2006 | Chen et al. | |
| 2006/0032677 | A1 | 2/2006 | Azar et al. | |
| 2006/0162969 | A1 | 7/2006 | Belnap et al. | |
| 2006/0196699 | A1 * | 9/2006 | Estes et al. | 175/374 |
| 2006/0254830 | A1 | 11/2006 | Radtke | |
| 2006/0266558 | A1 | 11/2006 | Middlemiss et al. | |
| 2006/0266559 | A1 | 11/2006 | Keshavan et al. | |
| 2006/0278442 | A1 | 12/2006 | Kristensen | |
| 2006/0283640 | A1 | 12/2006 | Estes et al. | |
| 2007/0029114 | A1 | 2/2007 | Middlemiss | |
| 2007/0062736 | A1 | 3/2007 | Cariveau et al. | |
| 2007/0079994 | A1 | 4/2007 | Middlemiss | |
| 2007/0187155 | A1 | 8/2007 | Middlemiss | |
| 2007/0221417 | A1 | 9/2007 | Hall et al. | |
| 2008/0066970 | A1 | 3/2008 | Zahradnik et al. | |
| 2008/0264695 | A1 | 10/2008 | Zahradnik et al. | |
| 2008/0296068 | A1 | 12/2008 | Zahradnik et al. | |
| 2009/0114454 | A1 | 5/2009 | Belnap et al. | |
| 2009/0126998 | A1 | 5/2009 | Zahradnik et al. | |
| 2009/0159338 | A1 | 6/2009 | Buske | |
| 2009/0159341 | A1 | 6/2009 | Pessier et al. | |
| 2009/0166093 | A1 | 7/2009 | Pessier et al. | |
| 2009/0178855 | A1 | 7/2009 | Zhang et al. | |
| 2009/0183925 | A1 | 7/2009 | Zhang et al. | |
| 2011/0024197 | A1 | 2/2011 | Centala et al. | |
| 2011/0162893 | A1 | 7/2011 | Zhang | |

FOREIGN PATENT DOCUMENTS

| | | |
|---|---|---|
| EP | 0225101 | 6/1987 |
| EP | 0157278 | 11/1989 |
| EP | 0391683 | 1/1996 |
| EP | 0874128 | 10/1998 |
| EP | 2089187 | 8/2009 |
| GB | 2183694 | 6/1987 |
| JP | 2000080878 | 3/2000 |
| JP | 2001159289 | 6/2001 |
| SU | 1 331 988 | 8/1987 |
| WO | 8502223 | 5/1985 |
| WO | 2008124572 | 10/2008 |

OTHER PUBLICATIONS

Jung Hye Lee, International Search Report for International Patent Application No. PCT/US2009/042514, Korean Intellectual Property Office, dated Nov. 27, 2009.

Jung Hye Lee, Written Opinion for International Patent Application No. PCT/US2009/042514, Korean Intellectual Property Office, dated Nov. 27, 2009.

Kang, K.H., International Search Report for International Patent Application No. PCT/US2010/033513, Korean Intellectual Property Office, dated Jan. 10, 2011.

Kang, K.H., Written Opinion for International Patent Application No. PCT/US2010/033513, Korean Intellectual Property Office, dated Jan. 10, 2011.

Kang, M.S., International Search Report for International Patent Application No. PCT/US2010/032511, Korean Intellectual Property Office, dated Jan. 17, 2011.

Kang, M.S., Written Opinion for International Patent Application No. PCT/US2010/032511, Korean Intellectual Property Office, dated Jan. 17, 2011.

Choi, J.S., International Search Report for International Patent Application No. PCT/US2010/039100, Korean Intellectual Property Office, dated Jan. 25, 2011.

Choi, J.S., Written Opinion for International Patent Application No. PCT/US2010/039100, Korean Intellectual Property Office, dated Jan. 25, 2011.

Baharlou, S., International Preliminary Report on Patentability, The International Bureau of WIPO, dated Jan. 25, 2011.

International Search Report for corresponding International patent application No. PCT/US2008/083532.

Written Opinion for corresponding International patent application No. PCT/US2008/083532.

Sheppard, N. and Dolly, B. "Rock Drilling—Hybrid Bit Success for Syndax3 Pins." Industrial Diamond Review, Jun. 1993, pp. 309-311.

Tomlinson, P. and Clark, I. "Rock Drilling—Syndax3 Pins—New Concepts in PCD Drilling." Industrial Diamond Review, Mar. 1992, pp. 109-114.

Williams, J. and Thompson, A. "An Analysis of the Performance of PDC Hybrid Drill Bits." SPE/IADC 16117, SPE/IADC Drilling Conference, Mar. 1987, pp. 585-594.

Warren, T. and Sinor L. "PDC Bits: What's Needed to Meet Tomorrow's Challenge." SPE 27978, University of Tulsa Centennial Petroleum Engineering Symposium, Aug. 1994, pp. 207-214.

Smith Services. "Hole Opener—Model 6980 Hole Opener." [retrieved from the Internet on May 7, 2008 using <URL: http://www.siismithservices.com/b_products/product_page.asp?ID=589>].

Mills Machine Company, Inc. "Rotary Hole Openers—Section 8." [retrieved from the Internet on Apr. 27, 2009 using <URL: http://www.millsmachine.com/pages/home_page/mills_catalog/cat_holeopen/cat_holeopen.pdf>].

Ersoy, A. and Waller, M. "Wear characteristics of PDC pin and hybrid core bits in rock drilling." Wear 188, Elsevier Science S.A., Mar. 1995, pp. 150-165.

Sung Joon Lee, International Search Report for International Patent Application No. PCT/US2009/050672, Korean Intellectual Property Office, dated Mar. 3, 2010.

Sung Joon Lee, Written Opinion for International Patent Application No. PCT/US2009/050672, Korean Intellectual Property Office, dated Mar. 3, 2010.

Pessier, R. and Damschen, M., "Hybrid Bits Offer Distinct Advantages in Selected Roller Cone and PDC Bit Applications," IADC/SPE Drilling Conference and Exhibition, Feb. 2-4, 2010, New Orleans.

S.H. Kim, International Search Report for International Patent Application No. PCT/US2009/067969, Korean Intellectual Property Office, dated May 25, 2010.

S.H. Kim, Written Opinion for International Patent Application No. PCT/US2009/067969, Korean Intellectual Property Office, dated May 25, 2010.

R. Buske, C. Rickabaugh, J. Bradford, H. Lukasewich and J. Overstreet. "Performance Paradigm Shift: Drilling Vertical and Directional Sections Through Abrasive Formations with Roller Cone Bits." Society of Petroleum Engineers—SPE 114975, CIPC/SPE Gas Technology Symposium 2008 Joint Conference, Canada, Jun. 16-19, 2008.

Dr. M. Wells, T. Marvel and C. Beuershausen. "Bit Balling Mitigation in PDC Bit Design." International Association of Drilling Contractors/Society of Petroleum Engineers—IADC/SPE 114673, IADC/SPE Asia Pacific Drilling Technology Conference and Exhibition, Indonesia, Aug. 25-27, 2008.

B. George, E. Grayson, R. Lays, F. Felderhoff, M. Doster and M. Holmes. "Significant Cost Savings Achieved Through the Use of PDC Bits in Compressed Air/Foam Applications." Society of Petroleum Engineers—SPE 116118, 2008 SPE Annual Technical Conference and Exhibition, Denver, Colorado, Sep. 21-24, 2008.

Georgescu, M., International Search Report for International Patent Application No. PCT/US2010/051019, dated Jun. 6, 2011, European Patent Office.

Georgescu, M., Written Opinion for International Patent Application No. PCT/US20101051019, dated Jun. 6, 2011, European Patent Office.

Georgescu, M., International Search Report for International Patent Application No. PCT/US2010/051020, dated Jun. 1, 2011, European Patent Office.

Georgescu, M., Written Opinion for International Patent Application No. PCT/US2010/051020, dated Jun. 1, 2011, European Patent Office.
Georgescu, M., International Search Report for International Patent Application No. PCT/US2010/051017, dated Jun. 8, 2011, European Patent Office.
Georgescu, M., Written Opinion for International Patent Application No. PCT/US2010/051017, dated Jun. 8, 2011, European Patent Office.
Georgescu, M., International Search Report for International Patent Application No. PCT/US2010/051014, dated Jun. 9, 2011, European Patent Office.
Georgescu, M., Written Opinion for International Patent Application No. PCT/US2010/051014, dated Jun. 9, 2011, European Patent Office.
Georgescu, M., International Search Report for International Patent Application No. PCT/US2010/050631, dated Jun. 10, 2011, European Patent Office.
Georgescu, M., Written Opinion for International Patent Application No. PCT/US2010/050631, dated Jun. 10, 2011, European Patent Office.

* cited by examiner

ADAPTIVE CONTROL CONCEPT FOR HYBRID PDC/ROLLER CONE BITS

TITLE OF THE INVENTION

Adaptive Control Concept for Hybrid PDC/Roller Cone Bits

CROSS REFERENCE TO RELATED APPLICATIONS

None.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to earth boring drill bits; and more specifically relate to hybrid PDC/roller cone earth boring drill bits.

2. Description of the Related Art

U.S. Pat. No. 4,343,371 discloses a "hybrid rock bit . . . wherein a pair of opposing extended nozzle drag bit legs are positioned adjacent a pair of opposed tungsten carbide roller cones. The extended nozzle face nearest the hole bottom has a multiplicity of diamond inserts mounted therein. The diamond inserts are strategically positioned to remove the ridges between the kerf rows in the hole bottom formed by the inserts in the roller cones."

U.S. Pat. No. 7,398,837 discloses a "drill bit assembly [that] has a body portion intermediate a shank portion and a working portion. The working portion has at least one cutting element. In some embodiments, the drill bit assembly has a shaft with an end substantially coaxial to a central axis of the assembly. The end of the shaft substantially protrudes from the working portion, and at least one downhole logging device is disposed within or in communication with the shaft."

U.S. Pat. No. 7,350,568 discloses a "method for logging a well. Includes receiving energy with at least one array of elements coupled to a drill bit, wherein the at least one array of elements functions as an electronic array. An apparatus for logging a well includes a drill bit and at least one array of elements coupled to the drill bit, wherein the at least one array of elements functions as an electronic array."

The inventions disclosed and taught herein are directed to an improved hybrid PDC/roller cone earth boring drill bit.

BRIEF SUMMARY OF THE INVENTION

The present invention includes an earth boring drill bit comprising a bit body having a longitudinal axis along a path of the bit, a first plurality of cutters mounted to the body, and a second plurality of cutters rotatably mounted to the body, wherein a longitudinal axial relationship between the first plurality of cutters and the second plurality of cutters is adjustable. The first and/or second plurality of cutters may be mounted to the body in such a manner as to allow them to move essentially parallel to the longitudinal axis. The longitudinal axial relationship may be adjusted to exchange the first plurality of cutters and the secondary plurality of cutters between a primary cutting position and a secondary cutting position. The bit may include one or more sensors to provide an indication of a formation type being excavated by the bit and a processor to control the longitudinal axial relationship based on the indication.

DETAILED DESCRIPTION

Figure 1:
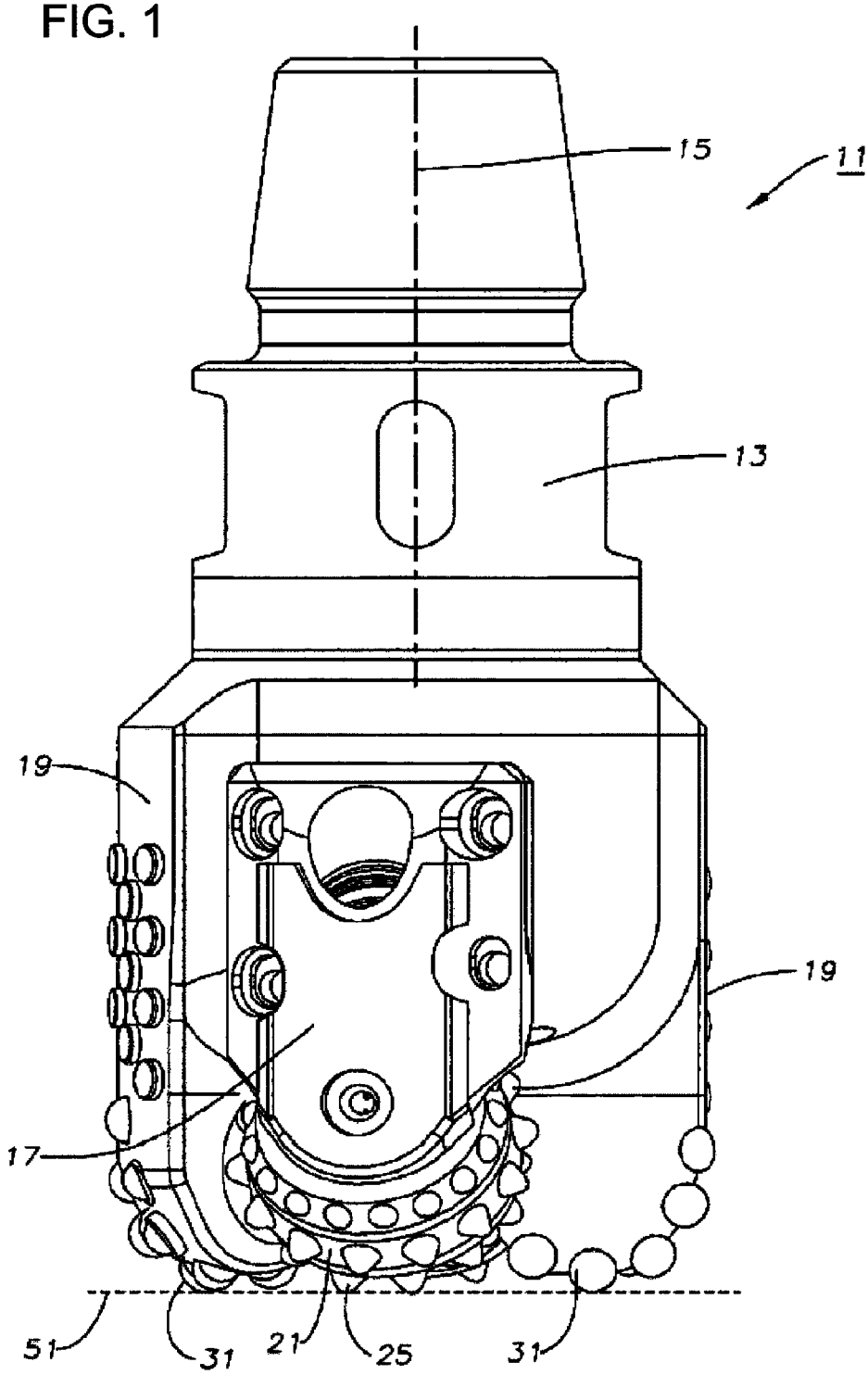
FIG. 1 illustrates a first elevation view of a particular embodiment of an earth boring drill bit utilizing certain aspects of the present inventions.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims.

Particular embodiments of the invention may be described below with reference to block diagrams and/or operational illustrations of methods. It will be understood that each block of the block diagrams and/or operational illustrations, and combinations of blocks in the block diagrams and/or operational illustrations, can be implemented by analog and/or digital hardware, and/or computer program instructions. Such computer program instructions may be provided to a processor of a general-purpose computer, special purpose computer, ASIC, and/or other programmable data processing system. The executed instructions may create structures and functions for implementing the actions specified in the block diagrams and/or operational illustrations. In some alternate implementations, the functions/actions/structures noted in the figures may occur out of the order noted in the block diagrams and/or operational illustrations. For example, two operations shown as occurring in succession, in fact, may be executed substantially concurrently or the operations may be executed in the reverse order, depending upon the functionality/acts/structure involved.

Computer programs for use with or by the embodiments disclosed herein may be written in an object oriented programming language, conventional procedural programming language, or lower-level code, such as assembly language and/or microcode. The program may be executed entirely on a single processor and/or across multiple processors, as a stand-alone software package or as part of another software package.

Applicants have created an earth boring drill bit comprising a bit body having a longitudinal axis along a path of the bit, a first plurality of cutters mounted to the body, and a second plurality of cutters rotatably mounted to the body, wherein a longitudinal axial relationship between the first plurality of cutters and the second plurality of cutters is adjustable. The first and/or second plurality of cutters may be mounted to the body in such a manner as to allow them to move essentially parallel to the longitudinal axis. The longitudinal axial relationship may be adjusted to exchange the first plurality of cutters and the secondary plurality of cutters between a primary cutting position and a secondary cutting position. The bit may include one or more sensors to provide an indication of a formation type being excavated by the bit and a processor to control the longitudinal axial relationship based on the indication.

FIG. 1 is an illustration of a hybrid bit 11 that incorporates both rolling cones and fixed polycrystalline diamond compact (PDC) cutters mounted on dual cutting structures, similar to those shown in U.S. Pat. No. 4,343,371 and U.S. Patent Application Publication No. 20080296068, both of which are incorporated herein by specific reference. More specifically, referring also to FIG. 2, the bit 11 comprises a bit body 13 having a longitudinal axis 15 that defines an axial center of the bit body 13. A plurality of roller cone support arms 17 extend from the bit body 13 in the longitudinal axial direction. The bit body 13 also has a plurality of blades 19 that extend in the longitudinal axial direction. The number of each of arms 17 and blades 19 is at least one but may be more than two.

Roller cones 21 are mounted to respective ones of the arms 17. A plurality of roller cone cutting inserts or cutters 25 are mounted to the roller cones 21. In this manner, the roller cone cutters 25 are rotatably mounted to the bit body 13. In addition, a plurality of fixed cutting elements 31, such as PDC cutters, are mounted to the blades 19. Examples of roller cone cutting elements 25 and fixed cutting elements 31 include tungsten carbide inserts, cutters made of super hard material such as polycrystalline diamond, and others known to those skilled in the art.

Figure 2:
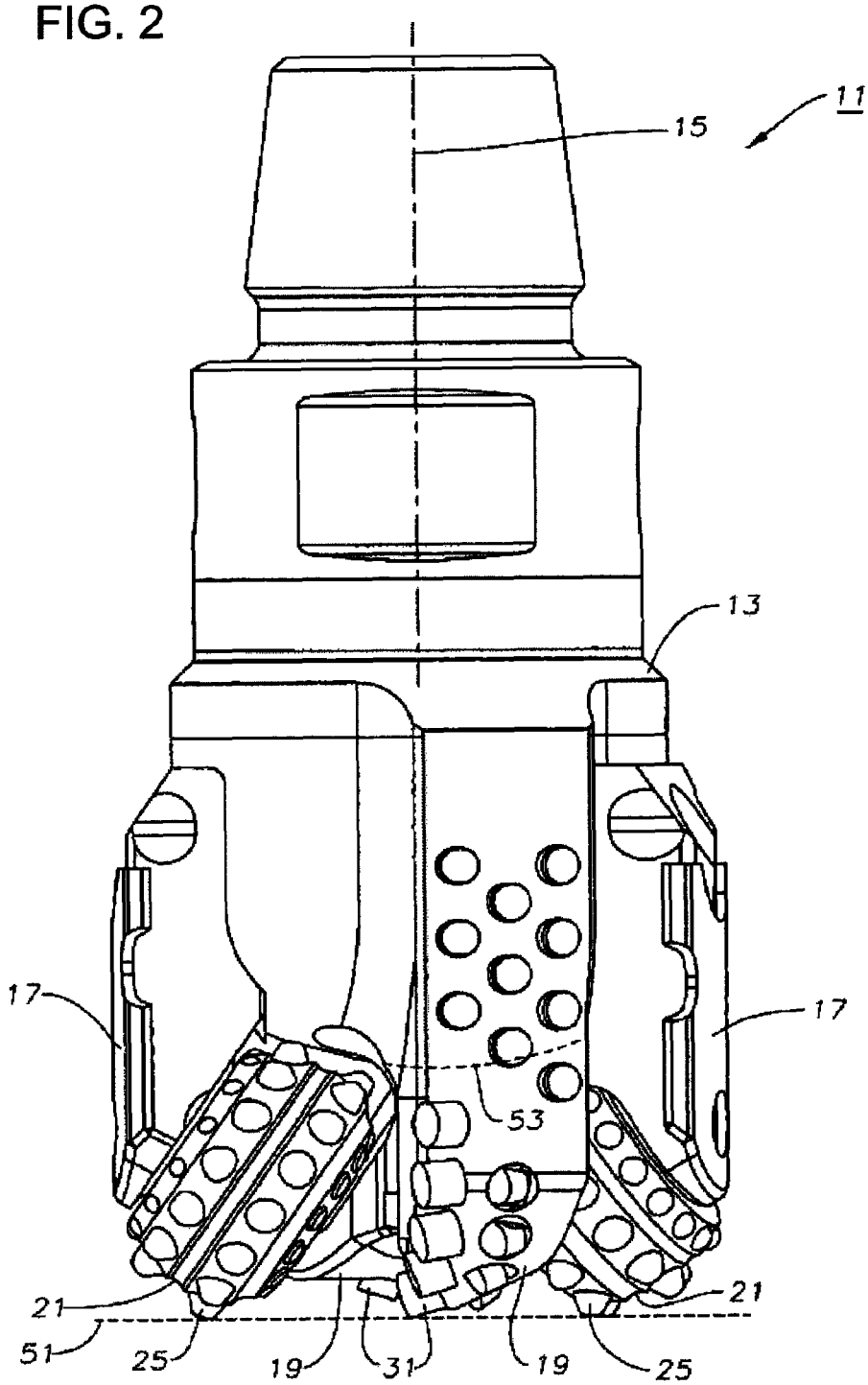
FIG. 2 illustrates a second elevation view of a particular embodiment of an earth boring drill bit utilizing certain aspects of the present inventions.

FIG. 1 and FIG. 2 show both the roller cone cutting elements 25 and fixed cutting elements 31 in a neutral position or relationship with regard to the longitudinal axis 15. In this position, the roller cone cutting elements 25 and fixed cutting elements 31 overlap and complement each other.

However, certain formation types favor the roller cone cutting elements 25 over the fixed cutting elements 31, or vice versa. For example, the roller cone cutting elements 25 are often better suited to dense rock formations, whereas the fixed cutting elements 31 may be better suited to softer or more homogeneous formations. Therefore, it is best to match the drill bit type to the formation type the bit 11 is expected to encounter. To further complicate matters, the drill bit 11 may encounter many different formation types while excavating a single well or borehole.

Therefore, the drill bit 11 of the present invention is preferably adjustable, such that either the roller cone cutting elements 25 or the fixed cutting elements 31 may be primary, with the other being secondary. In other words, the drill bit 11 of the present invention is preferably adjustable, such that either the roller cone cutting elements 25 may be in a primary cutting position, with the fixed cutting elements 31 in a secondary cutting position, and vice versa.

The present invention's ability to exchange the roller cone cutting elements 25 and the fixed cutting elements 31 between the primary cutting position and the secondary cutting position ensures that the formation is drilled, or excavated, as efficiently as possible with the least amount of wear on the bit 10. This ability to vary which elements 25,31 are primary and secondary may also improve the steerability of the bit 10 and bottom hole assembly (BHA) in varying formations.

In one embodiment, this adjustability is provided by mounting the roller cone cutting elements 25 and/or the fixed cutting elements 31 on the bit body 13 in such a manner as to allow them to be moved, or shifted, essentially parallel to the longitudinal axis 15 of the bit 11. In another embodiment, this adjustability is provided by mounting the arms 17 and/or the blades 19 on the bit body 13 in such a manner as to allow them to be moved essentially parallel to the longitudinal axis 15 of the bit 11. In one embodiment, the movement is essentially a linear shifting, or sliding, of the arms 17 and/or the blades 19 along the bit body 13, such as through the use of a track, rail, channel, or groove system. However, other forms of movement may be used and the movement may involve more than simple displacement along the longitudinal axis 15 of the bit 11. For example, the arms 17 and/or the blades 19 may be spirally, or helically, mounted on the bit body 13, such that the movement is a corkscrew motion about the body 13 of the bit 10. In still other embodiments, the movement may be even more complex. For example, the body 13 and the arms 17 and/or the blades 19 may have locking notched or toothed surfaces therebetween to prevent the arms 17 and/or the blades 19 from sliding with respect to the body 13, such that the arms 17 and/or the blades 19 move away from the body 13, slide, or shift, along the axis 15, and then move back toward the body 13. In any case, a longitudinal axial relationship between the roller cone cutting elements 25 and the fixed cutting elements 31 may be adjusted, such that the roller cone cutting elements 25 are in the primary cutting position, with the fixed cutting elements 31 in the secondary cutting position, or vice versa.

In this manner, the drill bit 11 of the present invention may be matched to the formation type being excavated. It should be understood that the primary cutting position is slightly deeper in the borehole than the secondary cutting position. This adjustment, or relative position/movement, may vary depending on many factors, such as bit or BHA design or application and/or the formation. In one embodiment, there may be approximately one eighth inch difference between the primary cutting position and the secondary cutting position.

In other embodiments, this difference, adjustment, or movement, may be between one and two hundredths of an inch. In still other embodiments, this difference, adjustment, or movement, may be between three thousandths of an inch and one quarter inch. Finally, in some embodiments, the bit 10 may accommodate more than one eighth of an inch of relative movement.

Figure 3:
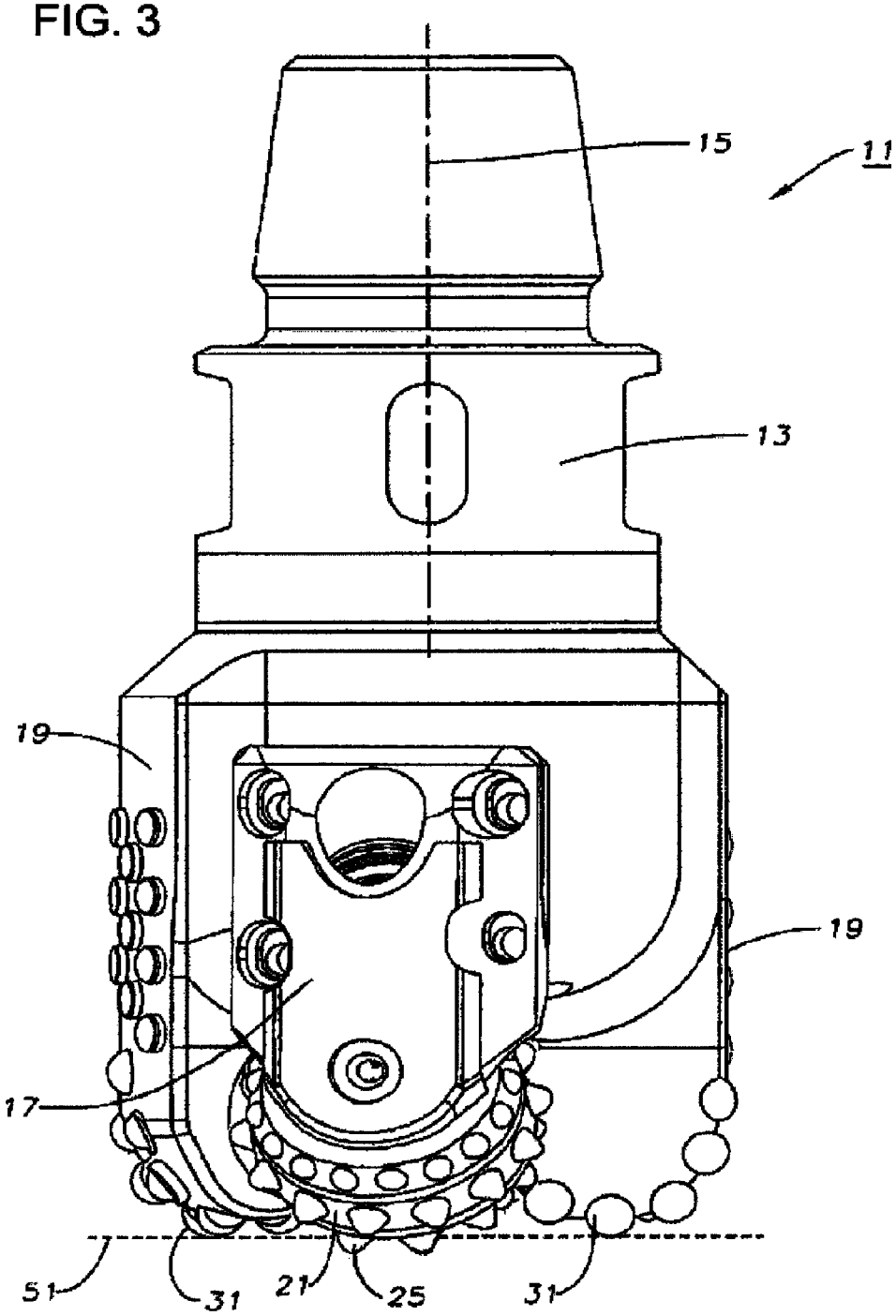
FIG. 3 illustrates a third elevation view of a particular embodiment of an earth boring drill bit utilizing certain aspects of the present inventions.
Figure 4:
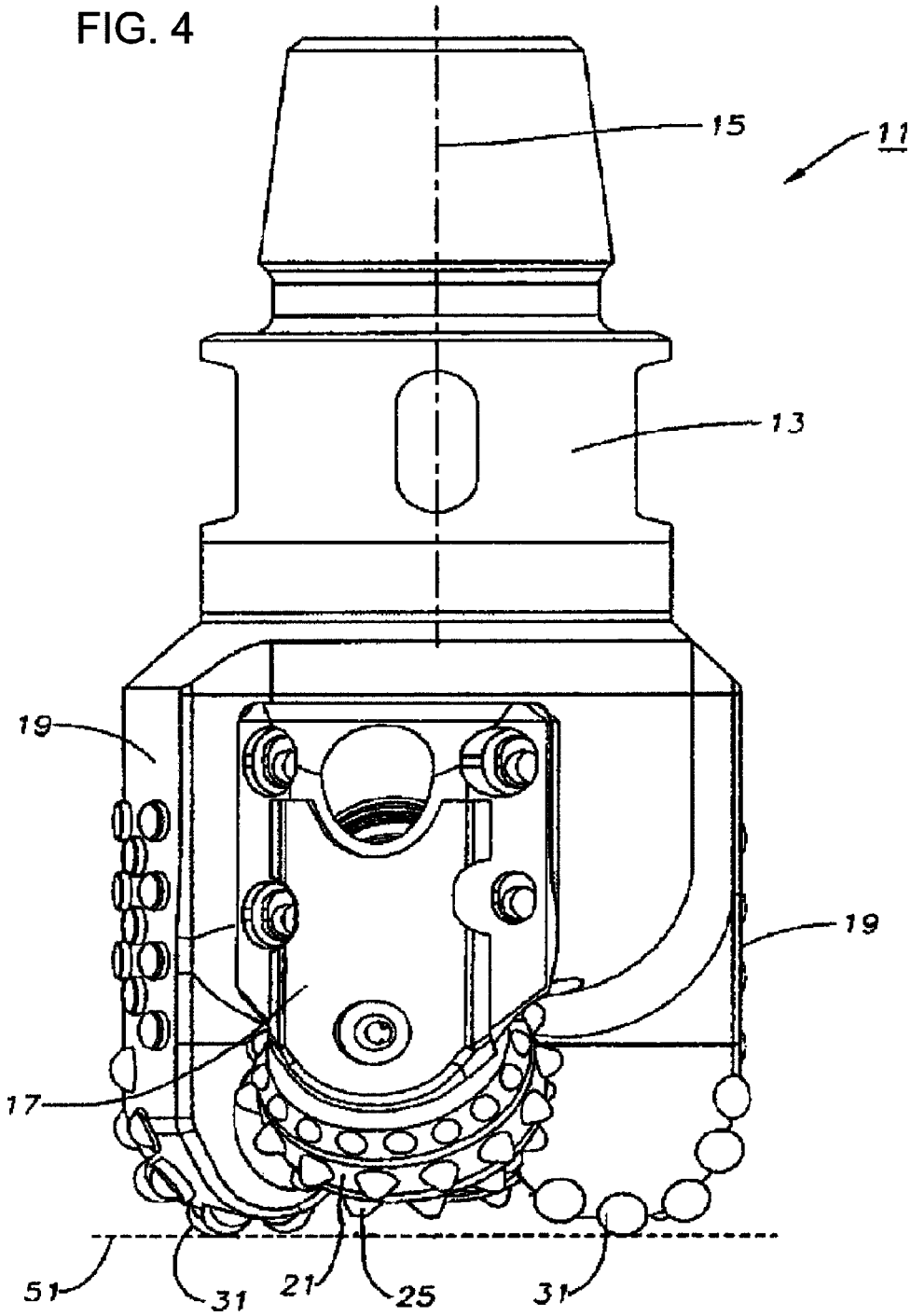
FIG. 4 illustrates a fourth elevation view of a particular embodiment of an earth boring drill bit utilizing certain aspects of the present inventions.

For example, as shown in FIG. 3, the arms 17 may be extended such than the roller cone cutting elements 25 extend beyond, or are deeper than, a cutting depth 51 of the fixed cutting elements 31 mounted on the blades 19. In the configuration shown in FIG. 3, the roller cone cutting elements 25 are in the primary cutting position, with the fixed cutting elements 31 in the secondary cutting position. Alternatively, as shown in FIG. 4, the arms 17 may be retracted such than the roller cone cutting elements 25 do not extend to, or are shallower than, the cutting depth 51 of the fixed cutting elements 31 mounted on the blades 19. In the configuration, shown in FIG. 4, the fixed cutting elements 31 are in the primary cutting position, with the roller cone cutting elements 25 in the secondary cutting position.

Such adjustment may be accomplished manually or automatically, at the surface or with the bit 11 in the borehole. This adjustment may be accomplished while actively drilling during a pause in drilling. For example, the bit 10 may be lifted off the More specifically, as shown in FIG. 5 and FIG. 6, in some embodiments, one or more sensors 61 provide some indication of the formation type being excavated by the bit 11 and a processor 65 controls the longitudinal axial relationship between the roller cone cutting elements 25, the fixed cutting elements 31, and/or the bit body 13 based on the indication.

Figure 5:
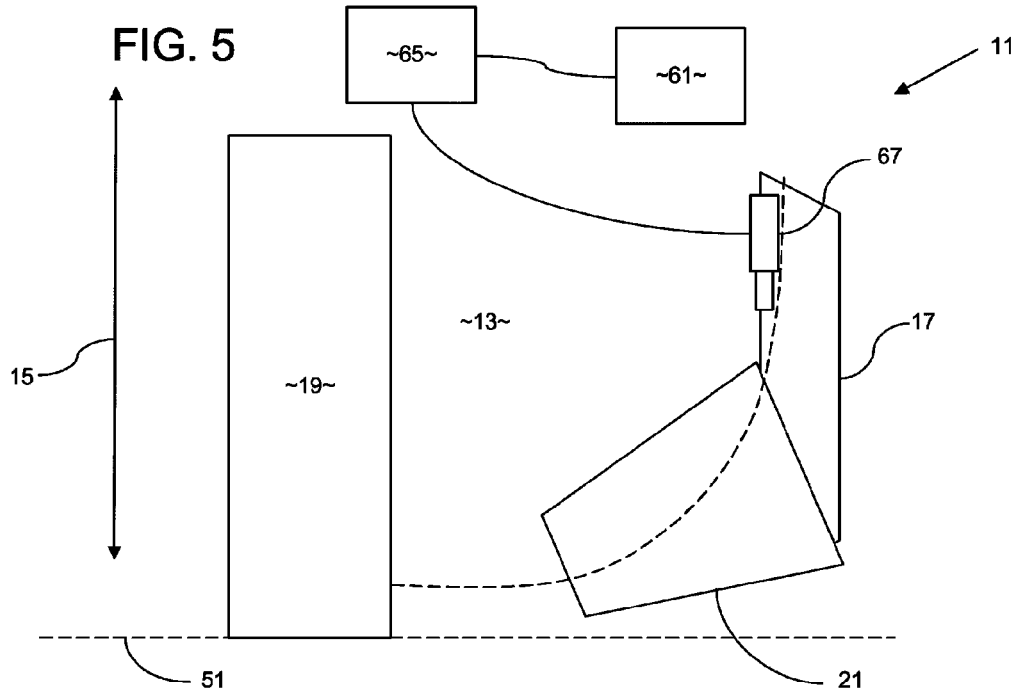
FIG. 5 illustrates a first simplified partial block diagram of a particular embodiment of an earth boring drill bit utilizing certain aspects of the present inventions.

For example, as shown in FIG. 5, the sensors 61 may sense a relatively soft formation type and provide an indication of the formation type to the processor 65. The processor 65 may decide to place the fixed cutting elements 31 in the primary cutting position and/or place the roller cone cutting elements 25 in the secondary cutting position. To do so, in some embodiments, the processor 65 triggers one or more actuators 67, causing the actuators 67 to retract the arms 17, thereby placing the roller cone cutting elements 25 in the secondary cutting position and the fixed cutting elements 31 in the primary cutting position.

Figure 6:
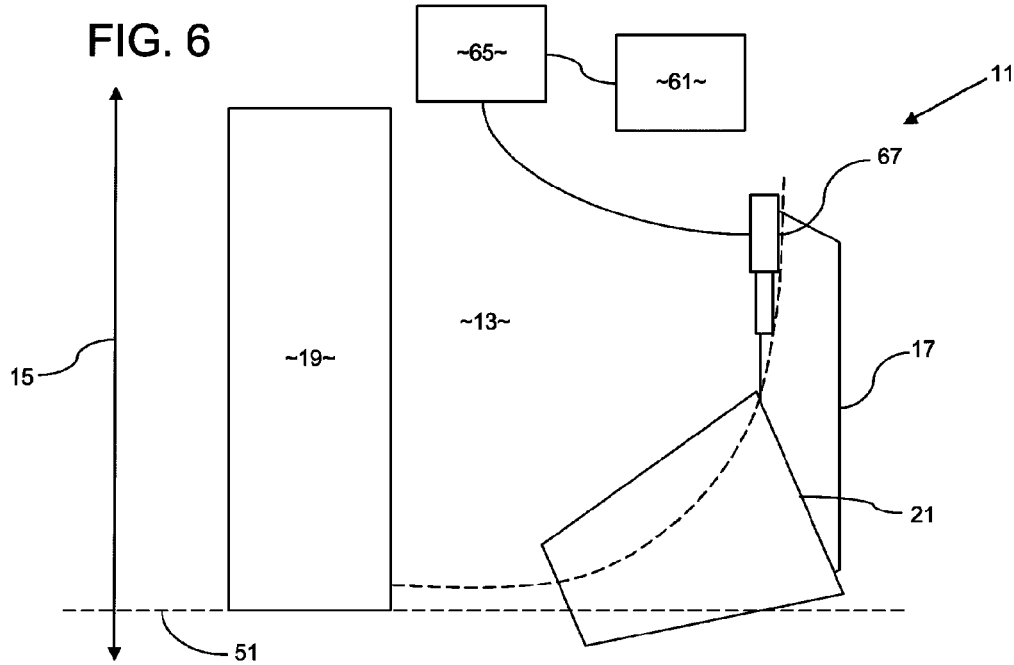
FIG. 6 illustrates a second simplified partial block diagram of a particular embodiment of an earth boring drill bit utilizing certain aspects of the present inventions.

Alternatively, as shown in FIG. 6, the sensor 61 may sense a relatively hard formation type and provide an indication of the formation type to the processor 65. The processor 65 may decide to place the roller cone cutting elements 25 in the primary cutting position and/or place the fixed cutting elements 31 in the secondary cutting position. To do so, in some embodiments, the processor 65 triggers the actuators 67, causing the actuators 67 to extend the arms 17, thereby placing the roller cone cutting elements 25 in the primary cutting position and the fixed cutting elements 31 in the secondary cutting position.

In this manner, the bit 11 of the present invention may exchange the fixed cutting elements 31 and the roller cone cutting elements 25 between the primary cutting position and the secondary cutting position. In other words, the longitudinal axial relationship between the first plurality of cutters and the second plurality of cutters may be adjusted in this manner. This exchange, or adjustment, may occur many times during excavation of a single borehole. Furthermore, this exchange, or adjustment, may be accomplished automatically, with or without intervention from an operator or external systems. Therefore, the sensor 61, the processor 65, and/or the actuators 67 may be internal to, or integral with, the bit 11. Alternatively, the sensor 61, the processor 65, and/or the actuators 67 may be external to the bit 11. For example, the sensors 61 and/or the processor 65 may be mounted within the bit body 13, in a shank of the bit 11, in a sub behind or above the bit 11, or be part of a measurement or logging while drilling (MWD) tool or a near bit resistivity tool. In one embodiment, the sensors 61 are placed as close to the cutting elements 25,31, or bit face, as possible in order to provide the formation type change indication as quickly as possible. However, sensors 61 in the bit shank and/or elsewhere in the BHA may provide the formation type indication soon enough for efficient operation, while keeping the sensors 61 protected.

The sensor(s) 61 may be gamma ray, resistivity, sonic, or other downhole real time sensors used to recognize formation changes and/or the current formation type being drilled. The formation type indication, formation type determination, and/or and indication of the relative positions of the fixed cutting elements 31 and the roller cone cutting elements 25 may be communicated to the surface. A operator at the surface may review this data and determine whether the positions need to be exchanged and communicate a command to the processor 65 and/or directly trigger the actuators 67. The actuators 67 may be hydraulic, electrical, and/or electromechanical. For example, the actuator(s) 67 may comprise a small downhole motor to compress or relax one or more spring loaded hydraulic pistons.

Other and further embodiments utilizing one or more aspects of the inventions described above can be devised without departing from the spirit of Applicant's invention. For example, while the roller cone support arm 17 has been shown to move with respect to the longitudinal axis 15 of the bit body 11, the blades 19 may move with respect to the longitudinal axis 15 of the bit body 11 in other embodiments. In other words, the roller cone support arm 17 and/or the blades 19 may slide with respect to the longitudinal axis 15 of the bit body 11. Thus, the roller cone cutting elements 25 and/or fixed cutting elements 31 may slide with respect to the other and/or the longitudinal axis 15 of the bit body 11. In some embodiments, only a portion of one or more blade(s) 19, or a select group of the cutters 25,31, may be moved to effectuate the change between primary and secondary cutting structures. The bit 10 may also include one or more locking lugs, or similar structure to prevent movement of the arms 17 and/or blades 19 with respect to the body 13. In this case, the bit 10 may include additional actuators 67 to engage/disengage the lugs. Alternatively, the actuators 67 may be configured to engage/disengage the lugs after/before moving the arms 17 and/or blades 19. In some embodiments, the roller cone cutting elements 25 and/or fixed cutting elements 31 may be placed in a neutral position, such as that shown in FIG. 1 and FIG. 2, as well as the primary and secondary positions shown in FIG. 3 and FIG. 4.

Additionally, rather than being embedded within the bit body 13, as shown, the sensor 61 and/or the processor 65 may be located elsewhere in the bottom hole assembly, drill string, and/or at the surface. Further, the various methods and embodiments of the present invention can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. An earth boring drill bit comprising:

a bit body having a longitudinal axis along a path of the bit;

a first plurality of cutters mounted to the body; a second plurality of cutters rotatably mounted to the body;

wherein a longitudinal axial relationship between the first plurality of cutters and the second plurality of cutters is adjustable;

a sensor providing an indication of a formation type being excavated by the bit; and a processor programmed to control the longitudinal axial relationship based on the indication.

2. The bit as set forth in claim 1, wherein the first plurality of cutters are mounted to the body in such a manner as to allow them to move along the longitudinal axis.

3. The bit as set forth in claim 1, wherein the second plurality of cutters are mounted to the body in such a manner as to allow them to move along the longitudinal axis.

4. The bit as set forth in claim 1, wherein the longitudinal axial relationship may be adjusted to exchange the first plurality of cutters and the secondary plurality of cutters between a primary cutting position and a secondary cutting position.

5. The bit as set forth in claim 1, wherein the processor is further programmed to cause the first plurality of cutters to shift parallel to the longitudinal axis based on the indication.

6. The bit as set forth in claim 1, wherein the processor is further programmed to cause the second plurality of cutters to shift parallel to the longitudinal axis based on the indication.

7. The bit as set forth in claim 1, wherein the processor is further programmed to adjust the longitudinal axial relationship to exchange the first plurality of cutters and the secondary plurality of cutters between a primary cutting position and a secondary cutting position based on the indication.

8. An earth boring drill bit assembly comprising:

a bit body having a longitudinal axis along a path of the bit;

a first plurality of cutters mounted to the body ;

a second plurality of cutters rotatably mounted to the body;

a sensor providing an indication of a formation type adjacent the body; and a processor programmed to control a longitudinal axial relationship between the first plurality of cutters and the second plurality of cutters based on the indication.

9. The bit assembly as set forth in claim 8, wherein the processor is further programmed to trigger at least one actuator to cause the first plurality of cutters to shift parallel to the longitudinal axis based on the indication.

10. The bit assembly as set forth in claim 8, wherein the processor is further programmed to trigger at least one actuator a plurality of actuators to cause the second plurality of cutters to shift parallel to the longitudinal axis based on the indication.

11. The bit assembly as set forth in claim 8, wherein the processor is further programmed to trigger at least one actuator a plurality of actuators to adjust the longitudinal axial relationship to exchange the first plurality of cutters and the secondary plurality of cutters between a primary cutting position and a secondary cutting position based on the indication.

12. A method of drilling a borehole in an earth formation, the method comprising the steps of:

receiving an indication of a formation type adjacent a drill bit from a sensor located within the borehole; and triggering an actuator to adjust a longitudinal axial relationship between a polycrystalline diamond compact (PDC) cutter and a roller cone cutter located on the drill bit in response to a processor programmed to analyze the indication.

13. The method as set forth in claim 12, wherein the triggering step comprises exchanging the PDC cutter and the roller cone cutter between a primary cutting position and a secondary cutting position.

14. The method as set forth in claim 12, wherein the triggering step comprises shifting the PDC cutter parallel to a longitudinal axis of the bit.

15. The method as set forth in claim 12, wherein the triggering step comprises shifting the roller cone cutter parallel to a longitudinal axis of the bit.

16. An earth boring drill bit assembly comprising:

a bit body having a longitudinal axis along a path of the bit;

at least one blade mounted to the body;

a first plurality of cutters fixedly mounted to the blade;

at least one leg mounted to the body a second plurality of cutters rotatably mounted to the leg;

a sensor providing an indication of a formation type adjacent the body; and a processor internal to the body and programmed to control a longitudinal axial relationship between the first plurality of cutters and the second plurality of cutters to exchange the first plurality of cutters and the secondary plurality of cutters between a primary cutting position and a secondary cutting position based on the indication.

17. The bit assembly as set forth in claim 16, further including at least one locking lug configured to prevent movement of the blade with respect to the body and wherein the processor is further programmed to trigger a plurality of actuators to disengage the lugs and cause the first plurality of cutters to shift parallel to the longitudinal axis based on the indication.

18. The bit assembly as set forth in claim 16, further including at least one locking lug configured to prevent movement of the leg with respect to the body and wherein the processor is further programmed to trigger a plurality of actuators to disengage the lugs and cause the second plurality of cutters to shift parallel to the longitudinal axis based on the indication.

* * * * *